US008587136B2

(12) United States Patent
Williams

(10) Patent No.: US 8,587,136 B2
(45) Date of Patent: Nov. 19, 2013

(54) MOBILE POWER SYSTEM

(75) Inventor: James Vernon Williams, Escondido, CA (US)

(73) Assignee: Solar Turbines Inc., San Diego, CA (US)

( * ) Notice: Subject to any disclaimer, the term of this patent is extended or adjusted under 35 U.S.C. 154(b) by 424 days.

(21) Appl. No.: 12/973,343

(22) Filed: Dec. 20, 2010

(65) Prior Publication Data

US 2012/0153634 A1 Jun. 21, 2012

(51) Int. Cl.

| | |
|---|---|
| ***F02B 63/04*** | (2006.01) |
| ***F03G 7/08*** | (2006.01) |
| ***H02K 7/18*** | (2006.01) |

(52) U.S. Cl.
USPC ..... 290/1 R; 290/1 A

(58) Field of Classification Search
USPC ..... 290/1 A, 1 R
See application file for complete search history.

(56) References Cited

U.S. PATENT DOCUMENTS

| | | | | | |
|---|---|---|---|---|---|
| 2,443,054 | A | * | 6/1948 | Putz et al. | 60/797 |
| 3,116,086 | A | * | 12/1963 | Barengoltz | 290/1 R |
| 3,418,485 | A | | 12/1968 | Anderson et al. | 290/1 R |
| 3,453,443 | A | * | 7/1969 | Stoeckly | 290/2 |
| 3,536,928 | A | * | 10/1970 | Jones, Jr et al. | 290/1 B |
| 3,791,682 | A | * | 2/1974 | Mitchell | 290/2 |
| 3,925,679 | A | | 12/1975 | Berman et al. | 290/1 R |
| 4,117,342 | A | * | 9/1978 | Melley, Jr. | 290/1 A |
| 4,136,432 | A | | 1/1979 | Melley, Jr. | 29/469 |
| 4,469,954 | A | * | 9/1984 | Maehara | 290/1 A |
| 4,992,669 | A | | 2/1991 | Parmley | 290/1 R |
| 5,517,822 | A | * | 5/1996 | Haws et al. | 60/618 |
| 5,642,702 | A | * | 7/1997 | Kouchi et al. | 123/198 E |
| 5,675,194 | A | * | 10/1997 | Domigan | 307/147 |
| 6,176,046 | B1 | * | 1/2001 | Quine et al. | 52/79.1 |
| 6,334,746 | B1 | * | 1/2002 | Nguyen et al. | 410/44 |
| 6,393,775 | B1 | * | 5/2002 | Staschik | 52/79.1 |
| 6,449,957 | B1 | | 9/2002 | Takamatsu et al. | 60/796 |
| 6,450,133 | B1 | * | 9/2002 | Bernard et al. | 123/2 |
| 6,644,247 | B2 | * | 11/2003 | Campion | 123/2 |
| 6,688,048 | B2 | * | 2/2004 | Staschik | 52/79.1 |
| 6,765,304 | B2 | | 7/2004 | Baten et al. | 290/1 A |
| 6,786,051 | B2 | | 9/2004 | Kristich et al. | 60/796 |

(Continued)

OTHER PUBLICATIONS

BGT Group, "Turbine Packages, Spare Parts, Maintenance," available at http://www.bgtgroup.com/, printed on Dec. 19, 2010, 1 page.

(Continued)

*Primary Examiner* — Pedro J Cuevas
(74) *Attorney, Agent, or Firm* — Finnegan, Henderson, Farabow, Garrett & Dunner LLP

(57) ABSTRACT

A mobile power system includes a first transportable body including a generator assembly and a second transportable body including a turbine assembly. One end of the second transportable body is attached to and faces an end of the first transportable body such that the first and second transportable bodies are generally collinear. The mobile power system also includes a third transportable body including auxiliary equipment and a fourth transportable body including electrical equipment. The third transportable body includes a portion that is generally aligned with at least a portion of the first and second transportable bodies along a direction that is generally perpendicular to a longitudinal direction of the third transportable body. The third transportable body is located between the fourth transportable body and the first and second transportable bodies. The first, second, third, and fourth transportable bodies are substantially parallel and are separately transportable.

33 Claims, 2 Drawing Sheets

(56) References Cited

U.S. PATENT DOCUMENTS

| | | | | |
|---|---|---|---|---|
| 6,877,581 | B2 * | 4/2005 | Badr et al. | 180/311 |
| 6,893,487 | B2 * | 5/2005 | Alger et al. | 95/273 |
| 7,081,682 | B2 * | 7/2006 | Campion | 290/1 A |
| 7,122,913 | B2 * | 10/2006 | Witten et al. | 290/1 A |
| 7,143,585 | B2 | 12/2006 | Kuroki et al. | 60/797 |
| 7,221,061 | B2 * | 5/2007 | Alger et al. | 290/1 R |
| 7,230,819 | B2 * | 6/2007 | Muchow et al. | 361/601 |
| 7,461,510 | B1 * | 12/2008 | Munson, Jr. | 60/796 |
| 7,466,033 | B2 * | 12/2008 | Witten et al. | 290/1 A |
| 7,608,934 | B1 * | 10/2009 | Hunter | 290/4 R |
| 8,198,966 | B2 * | 6/2012 | Thrue et al. | 336/90 |
| 8,221,626 | B2 * | 7/2012 | Sassow | 210/603 |
| 8,294,285 | B2 * | 10/2012 | Hunter | 290/1 R |
| 8,450,863 | B2 * | 5/2013 | Farr et al. | 290/1 A |
| 2002/0189173 | A1 * | 12/2002 | Staschik | 52/79.1 |
| 2003/0030279 | A1 * | 2/2003 | Campion | 290/1 A |
| 2003/0030281 | A1 * | 2/2003 | Campion | 290/1 R |
| 2003/0079479 | A1 | 5/2003 | Kristich et al. | 60/797 |
| 2006/0272559 | A1 * | 12/2006 | Liu | 110/250 |
| 2009/0015021 | A1 | 1/2009 | Towada | 290/1 A |
| 2010/0060093 | A1 * | 3/2010 | Hunter | 310/89 |
| 2011/0057454 | A1 * | 3/2011 | Kawakita et al. | 290/1 A |
| 2011/0083578 | A1 * | 4/2011 | Sami | 105/50 |
| 2011/0089911 | A1 * | 4/2011 | Loisel et al. | 322/88 |
| 2011/0146751 | A1 * | 6/2011 | McGuire et al. | 136/245 |

OTHER PUBLICATIONS

GE Energy Rentals, TM2500 Technical Overview, Sep. 2000, available at http://www.brownsequipment.com/files/item_files/files/15183.pdf, 14 pages.

GE Energy, "GE Energy Launches New Upgrade to Its Mobile Power Unit," Press Release, Dec. 2, 2008, available at http://www.genewscentercom/content/detail.aspx?ReleaseID=4894&NewsArealD=2&PrintPreview=True, 2 pages.

HKJ Gas Turbine Services A/S, Mobile Power Generation Equipment: Nomad 5—3.8 Mw/4875 Kva 50Hz 11KV Mobile Power Station, available at http://www.hkj.dk/component/flippingbook/book/3, printed on Dec. 19, 2010, 12 pages.

HKJ Gas Turbine Services A/S, "HKJ Semi-Mobile Power Generation Equipment," available at http://www.hkj.dk/component/flippingbook/book/4, printed on Dec. 19, 2010, 12 pages.

Pratt & Whitney Power Systems, "FT8 MOBILEPACc Gas Turbine Package," available at http://www.pw.utc.com/StaticFiles/Pratt%20& %20Whitney%20New/Media%20Center/Press%20Kit/1%20Static%20Files/pwps_mobilepac_fact_sheet.pdf, printed on Dec. 19, 2010, 2 pages.

Solar Turbines Incorporated, Titan 130 Mobile Power Unit product brochure, available at http://mysolar.cat.com/cda/files/126901/7/ds130mpu.pdf, 2009, 2 pages.

Solar Turbines Incorporated, Taurus 60 Mobile Power Unit product brochure, available at http://mysolar.cat.com/cda/files112690717/ds60mpu.pdf, 2009, 2 pages.

* cited by examiner

MOBILE POWER SYSTEM

TECHNICAL FIELD

The present disclosure relates generally to a system for generating power, and more particularly, to a mobile system for generating power.

BACKGROUND

Mobile power generation systems may be transported to different locations to deliver power at those locations, e.g., at times of peak demand or of brownout in a distribution grid or network, or in an emergency or other problem in the distribution grid as a result of a power grid failure or some other type of event. The mobile power generation system may also be set up at locations that are distant from a distribution grid where there is need for power.

Mobile power generation systems may be transported using one or more trailers. Thus, such a system may need to comply with weight and height restrictions from relevant highway regulatory and governmental agencies, in addition to other limitations, in order to provide trailers that are highway transportable.

One method of providing a trailer-mounted mobile power system is described in U.S. Pat. No. 6,786,051 (the '051 patent) issued to Kristich et al. The '051 patent describes a trailer-mounted mobile power system that includes six separate trailers. Although the system of the '051 patent may be trailer-mounted and thus transportable, the system of the '051 patent includes a relatively high number of trailers, which may have a larger footprint at the deployment site. Also, the configuration of the trailers and the configuration of the components within the various trailers may require longer lengths of cables, hoses, pipes, or other connections to connect the components of the trailers together to be able to generate power.

The disclosed system is directed to overcoming one or more of the problems set forth above.

SUMMARY

In one aspect, the present disclosure is directed to a mobile power system including a first transportable body including a generator assembly and a second transportable body including a turbine assembly. One of the ends of the second transportable body is attached to and faces one of the ends of the first transportable body such that the first transportable body and the second transportable body are generally collinear. The mobile power system also includes a third transportable body including auxiliary equipment. The third transportable body includes a portion that is generally aligned with at least a portion of the first and second transportable bodies along a direction that is generally perpendicular to a longitudinal direction of the third transportable body. The mobile power system further includes a fourth transportable body including electrical equipment. The third transportable body is located between the fourth transportable body and the first and second transportable bodies. The first transportable body, the second transportable body, the third transportable body, and the fourth transportable body are substantially parallel and are separately transportable.

In another aspect, the present disclosure is directed to a method of assembling a mobile power system at an assembly location. The method includes separately transporting to the assembly location a first transportable body, a second transportable body, a third transportable body, and a fourth transportable body of the mobile power system. The first transportable body includes a generator assembly, the second transportable body includes a turbine assembly, the third transportable body includes auxiliary equipment, and the fourth transportable body includes electrical equipment. The method also includes attaching, at the assembly location, the first transportable body to the second transportable body such that the first transportable body and the second transportable body are generally collinear. The method further includes positioning, at the assembly location, the third transportable body generally parallel to the fourth transportable body and the attached first and second transportable bodies, and between the attached first and second transportable bodies and the fourth transportable body. The method further includes deploying at least one walkway when the third transportable body is positioned at the assembly location, the at least one walkway being attached to an outer surface of the third transportable body and configured to change between a deployed state and a stowed state.

In a further aspect, the present disclosure is directed to a method of assembling a mobile power system at an assembly location. The method includes separately transporting to the assembly location a first trailer, a second trailer, a third trailer, and a fourth trailer of the mobile power system. The first trailer includes a generator assembly, the second trailer includes a turbine assembly, the third trailer includes auxiliary equipment, and the fourth trailer includes electrical equipment. The method also includes attaching, at the assembly location, the first trailer to the second trailer such that the first trailer and the second trailer are generally collinear. The method further includes positioning, at the assembly location, the third trailer adjacent to the attached first and second trailers such that the third trailer is generally parallelly spaced from the attached first and second trailers. The method also includes positioning, at the assembly location, the fourth trailer adjacent to the third trailer such that the fourth trailer is generally parallelly spaced from the third trailer.

DETAILED DESCRIPTION

Figure 1:
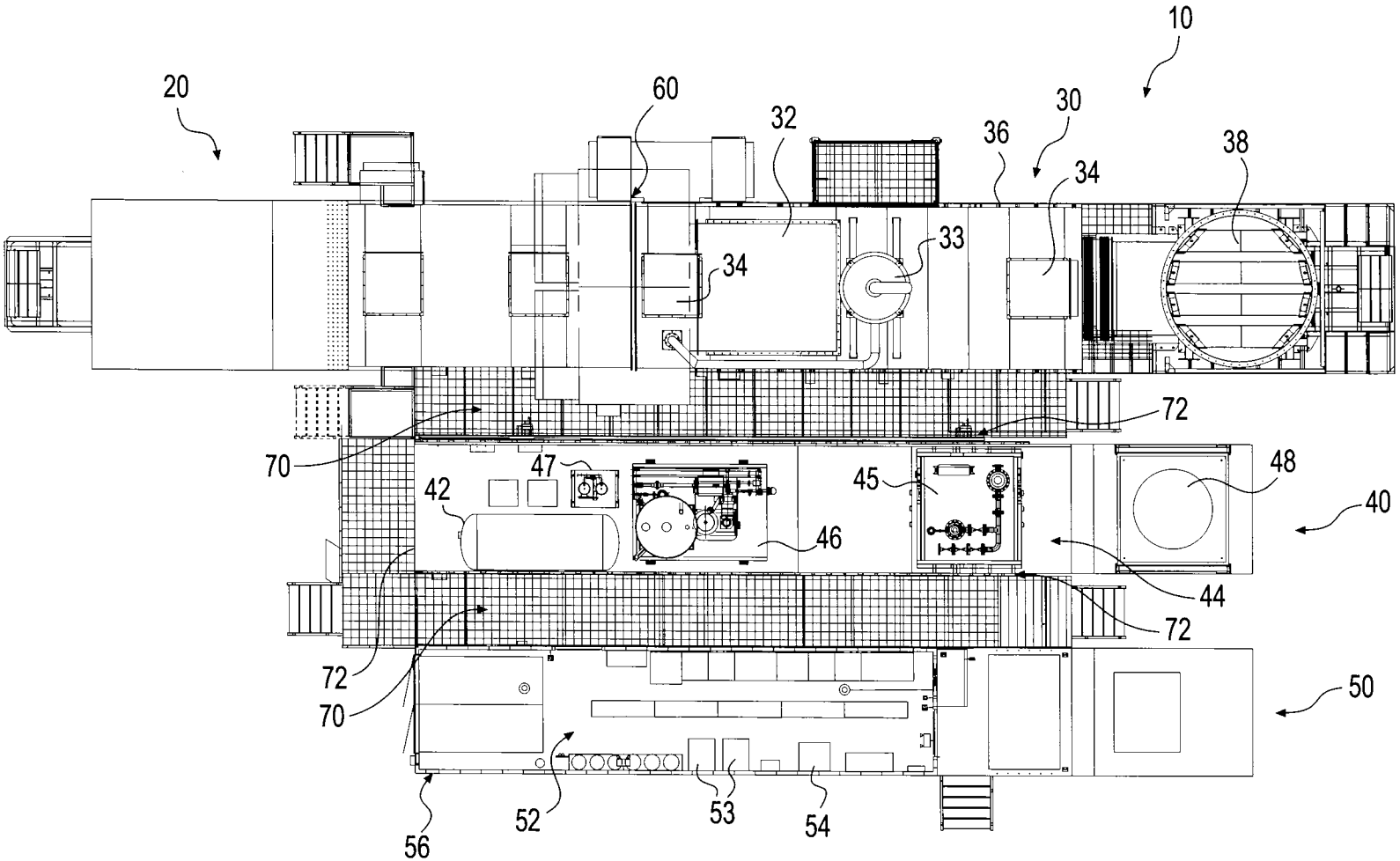
FIG. 1 is a top view of a mobile power system, according to an exemplary embodiment.
Figure 2:
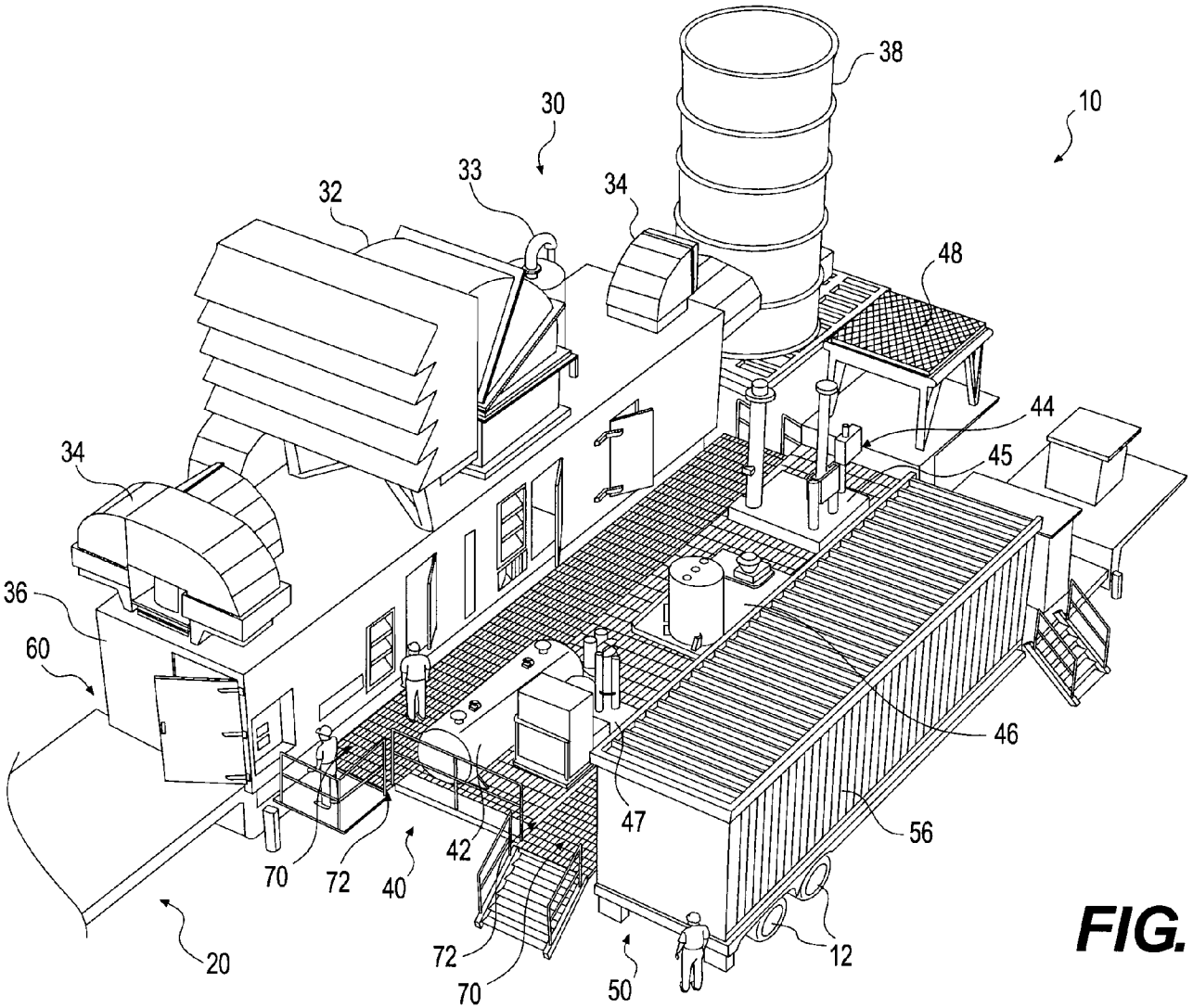
FIG. 2 is a perspective view of the mobile power system.

FIGS. 1 and 2 illustrate an exemplary mobile power system 10 having multiple systems and components that cooperate to generate power. The mobile power system 10 may be provided at locations, e.g., where supplemental power may be needed, at times of peak demand or brownout in a distribution grid or network, in an emergency or other problem in the distribution grid, or other type of event. The mobile power system 10 may be provided to generate power for delivering to the distribution grid or to any device or system capable of receiving, using, and/or storing power. In the exemplary embodiment, the mobile power system 10 includes a gas turbine power generator.

The mobile power system 10 may be transported between locations, and, at a particular location, the mobile power system 10 may be deployed or assembled to provide power at that location. Accordingly, the mobile power system 10 may have a first configuration during transport and a second configuration when deployed or assembled at the deployment or assembly location.

The mobile power system 10 may include one or more trailers or other transportable bodies, frames, housings, platforms, etc. For example, as shown in FIG. 1, the exemplary mobile power system 10 includes a generator trailer 20, a turbine trailer 30, an auxiliary equipment trailer 40, and an electrical equipment trailer 50. The trailers 20, 30, 40, 50 may include wheels 12 to allow the trailers 20, 30, 40, 50 to be separately transportable, and towed or hauled by respective vehicles, such as trucks or other machines. The trailers 20, 30, 40, 50 may include hitches or other devices that allow the trailers 20, 30, 40, 50 to be towed or hauled by the respective vehicles. The trailers 20, 30, 40, 50 may also comply with relevant governmental regulations or other regulations, such as highway regulations, which may include limitations on size (e.g., height, length, width, etc.), weight, emissions, noise, etc.

The trailers 20, 30, 40, 50 may include a closed body, framework, housing, or other conveyance, such as the turbine trailer 30 and the electrical equipment trailer 50 shown in FIG. 2. The closed body may be a closed housing with various components that allow access to components inside the body, such as doors, panels, openings, vents, etc. The trailers 20, 30, 40, 50 may also include an open (e.g., open-topped) body, framework, housing, platform, or other conveyance, such as the generator trailer 20 and the auxiliary equipment trailer 40 shown in FIG. 2. Alternatively, the trailers 20, 30, 40, 50 may include a portion that is closed and a portion that is open.

The trailers 20, 30, 40, 50 may include trailer jacks or other devices that allow the trailers 20, 30, 40, 50 to be supported or leveled on the ground. The leveling or supporting devices may be operated hydraulically. Alternatively, the leveling devices may be operated mechanically (e.g., using a forklift), etc.

FIGS. 1 and 2 show the trailers 20, 30, 40, 50 that are set up and assembled at the assembly location. At the assembly location, the generator trailer 20 and the turbine trailer 30 may be attached and generally collinear, and the auxiliary trailer 40 and the electrical equipment trailer 50 may be parallelly spaced from the attached generator trailer 20 and turbine trailer 30. Thus, the longitudinal directions (or axes) of the trailers 20, 30, 40, 50 may be substantially parallel.

The generator trailer 20 may include a generator assembly. The ends of the generator trailer 20 include a first end and a second end positioned at opposite ends along a longitudinal direction of the generator trailer 20. The generator trailer 20 and the turbine trailer 30 may be connected together. For example, after positioning the generator trailer 20 and the turbine trailer 30 in place at the assembly location, as shown in FIGS. 1 and 2, and leveling the trailers 20, 30, bolts or other securing mechanisms may be used to form a connection 60 between the opposing surfaces of the generator trailer 20 and the turbine trailer 30.

The turbine trailer 30 may include a turbine assembly. The turbine assembly may include a gas turbine that drives the generator assembly of the generator trailer 20. The ends of the turbine trailer 30 may include a first end and a second end positioned at opposite ends along a longitudinal direction of the turbine trailer 30. As shown in FIGS. 1 and 2, one of the ends of the turbine trailer 30 may be attached to and face one of the ends of the generator trailer 20 such that the generator trailer 20 and the turbine trailer 30 may be generally collinear.

The turbine assembly in the turbine trailer 30 may include fuel system components that may receive fuel from the auxiliary equipment trailer 40 as will be described below. The turbine assembly may also include a combustion section where combustion occurs, an air filter 32, an oil mist eliminator 33, and enclosure vent fans 34 positioned on top of a turbine housing 36, and an exhaust stack silencer 38 (or muffler).

The auxiliary equipment trailer 40 may include auxiliary equipment. The auxiliary equipment trailer 40 may be substantially parallel to the generator trailer 20, the turbine trailer 30, and the electrical equipment trailer 50, and spaced apart from the generator trailer 20, the turbine trailer 30, and the electrical equipment trailer 50. The auxiliary equipment trailer 40 may be located between electrical equipment trailer 50 and the generator trailer 20 and the turbine trailer 30. The auxiliary equipment in the auxiliary equipment trailer 40 is arranged in slightly different configurations in FIGS. 1 and 2.

The auxiliary equipment trailer 40 may include at least one of an air compressor system 42 configured to supply compressed air to the generator assembly in the generator trailer 20 and/or to the turbine assembly in the turbine trailer 30. The air compressor system 42 may be generally aligned with the electrical equipment of the electrical equipment trailer 50 configured to connect to the air compressor system 42 using a connecting line that extends along a direction that is generally perpendicular to the longitudinal direction of the auxiliary equipment trailer 40 and/or the longitudinal direction of the electrical equipment trailer 50. The air compressor system 42 may also be generally aligned with and connected to the turbine assembly in the turbine trailer 30 using a connecting line that extends along a direction that is generally perpendicular to the longitudinal direction of the auxiliary equipment trailer 40 and/or the longitudinal direction of the turbine trailer 30. The connecting lines described above may be bundled with other connecting lines for providing mechanical and/or electrical connections between the auxiliary equipment trailer 40 and the turbine trailer 30 and/or the electrical equipment trailer 50.

The auxiliary equipment of the auxiliary equipment trailer 40 may include fuel system components 44. For example, the fuel system components 44 may include a coalescer/heater 45, a centrifuge 46, a liquid fuel boost pump 47, etc. The fuel system components on the turbine trailer 30 and the fuel system components 44 on the auxiliary equipment trailer 40 may be included in a fuel system for the mobile power system 10, such as a diesel fuel system and/or a gas fuel system.

At least some of the fuel system components 44 on the auxiliary equipment trailer 40 may be generally aligned with the electrical equipment of the electrical equipment trailer 50 configured to connect to the fuel system components 44 using a connecting line that extends along a direction that is generally perpendicular to the longitudinal direction of the auxiliary equipment trailer 40 and/or the longitudinal direction of the electrical equipment trailer 50. At least some of the fuel system components 44 on the auxiliary equipment trailer 40 may also be generally aligned with and connected to at least some of the fuel system components on the turbine trailer 30 using a connecting line that extends along a direction that is generally perpendicular to the longitudinal direction of the auxiliary equipment trailer 40 and/or the longitudinal direction of the turbine trailer 30. The connecting lines described above may be bundled with other connecting lines for providing mechanical and/or electrical connections between the auxiliary equipment trailer 40 and the turbine trailer 30 and/or the electrical equipment trailer 50.

The auxiliary equipment on the auxiliary equipment trailer 40 may also include an oil cooler system 48 configured to deliver cooled lubrication oil to the turbine assembly of the turbine trailer 30. The oil cooler system 48 may be generally aligned with the electrical equipment of the electrical equipment trailer 50 that is configured to connect to the oil cooler system 48 using a connecting line. The connecting line may extend along a direction that is generally perpendicular to the longitudinal direction of the auxiliary equipment trailer 40 and/or the longitudinal direction of the electrical equipment trailer 50. The oil cooler system 48 may also be generally aligned with and connected to the turbine assembly in the turbine trailer 30 using a connecting line configured to deliver oil to the turbine assembly of the turbine trailer 30. The connecting line may extend along a direction that is generally perpendicular to the longitudinal direction of the auxiliary equipment trailer 40 and/or the longitudinal direction of the turbine trailer 30. The connecting lines described above may be bundled with other connecting lines for providing mechanical and/or electrical connections between the auxiliary equipment trailer 40 and the turbine trailer 30 and/or the electrical equipment trailer 50.

The electrical equipment trailer 50 may include electrical equipment 52, such as the electrical equipment described above for connecting to the air compressor system 42, the fuel system components 44, and the oil cooler system 48. For example, the electrical equipment 52 may include a battery system 53 or other power storage device, equipment for power conditioning or control 54 (e.g., a transformer, a ground resistor, etc.), a connector for connecting to a local power distribution grid, a protection device for the power delivery system (e.g., configured to monitor one or more switches used for delivery of power to a user or the power distribution grid, such as to monitor for an electrical upset), a fire extinguisher system for the turbine and generator assemblies, a remote system control console (e.g., for controlling the trailers 20, 30, 40, 50), etc. As shown in FIG. 2, some or all of the electrical equipment 52 may be stored in a power control room 56. The electrical equipment trailer 50 may be substantially parallel to the generator trailer 20, the turbine trailer 30, and the auxiliary equipment trailer 40. The electrical equipment trailer 50 may be spaced apart from the auxiliary equipment trailer 40.

The mobile power system 10 may also include one or more walkways 70 attached to the generator trailer 20, the turbine trailer 30, the auxiliary equipment trailer 40, and/or the electrical equipment trailer 50. For example, in the exemplary embodiment show in FIGS. 1 and 2, the walkways 70 are attached to side and end surfaces of the auxiliary equipment trailer 40, e.g., at a first side facing the generator trailer 20 and/or the turbine trailer 30, at a second side facing the electrical equipment trailer 50, and at one or both of the opposite longitudinal ends of the auxiliary equipment trailer 40.

The walkways 70 may be formed using panels, and the panels may be attached to sides of the auxiliary equipment trailer 40, e.g., using one or more hinges 72 that allow the panels to rotate between a deployed state and a stowed state. For example, the walkways 70 may be substantially vertical in the stowed state and substantially horizontal in the deployed state. The free ends of the panels (e.g., opposite the ends attached to the hinges 72) may be supported by brackets (not shown), e.g., on the generator trailer 20, the turbine trailer 30, and/or the electrical equipment trailer 50. One or more of the trailers 20, 30, 40, 50 may also include one or more securing mechanisms (not shown) that allow the walkways 70 to remain in the stowed state. When the walkways 70 are in the stowed state, the auxiliary equipment trailer 40 may be compliant with relevant governmental regulations as described above so that the auxiliary equipment trailer 40 may be transported with the walkways 70 in the stowed state.

As shown in FIGS. 1 and 2, one of the walkways 70 may extend between the auxiliary equipment trailer 40 and the generator trailer 20 and/or the turbine trailer 30 in the deployed state such that the walkway 70 may allow a user standing on the walkway 70 to access the generator trailer 20, the turbine trailer 30, and the auxiliary equipment trailer 40. Another walkway 70 may extend between the auxiliary equipment trailer 40 and the electrical equipment trailer 50 in the deployed state such that the at least one walkway may allow the user standing on the walkway 70 to access the auxiliary equipment trailer 40 and the electrical equipment trailer 50.

INDUSTRIAL APPLICABILITY

The disclosed mobile power system 10 may be applicable to any system that is transportable and that includes a power generation system. The disclosed mobile power system 10 may be more easily transportable, may have a smaller footprint, and may be easier and faster to assemble and disassemble. The transport and assembly of the mobile power system 10 will now be explained.

The trailers 20, 30, 40, 50 may be separately transported to an assembly location, e.g., a location where supplemental power is needed. For example, the trailers 20, 30, 40, 50 may be separately towed by respective vehicles.

At the assembly location, the generator trailer 20 and the turbine trailer 30 may be positioned as shown in FIGS. 1 and 2, disconnected from the respective towing vehicles, and then leveled, e.g., using a hydraulic leveling system or other leveling system. The generator trailer 20 and the turbine trailer 30 may be connected together, e.g., using bolts, to form the connection 60. The air filter 32, the oil mist eliminator 33, and the enclosure vent fans 34 may be stowed on another trailer, such as the auxiliary equipment trailer 40, during transport, and at the assembly location, the air filter 32, the oil mist eliminator 33, and the enclosure vent fans 34 may be positioned and attached to the top of the turbine housing 36, as shown in FIG. 2. Components of the generator trailer 20 and the turbine trailer 30 may be connected together mechanically and/or electrically using cables, hoses, pipes, or other types of connecting lines.

Also, at the assembly location, the auxiliary equipment trailer 40 may be positioned as shown in FIGS. 1 and 2, disconnected from the respective towing vehicle, and then leveled, e.g., using a hydraulic leveling system or other leveling system. Components of the generator trailer 20 and/or the turbine trailer 30 may be connected to components of the auxiliary equipment trailer 40 mechanically and/or electrically using cables, hoses, pipes, or other types of connecting lines, as described above. The connecting lines may be bundled together to allow the user to connect the components of the trailers 20, 30, 40 together relatively quickly and easily. For example, connecting lines connecting the auxiliary equipment trailer 40 and the turbine trailer 30 may be provided in one or more bundles, and connecting lines connecting the auxiliary equipment trailer 40 to the generator trailer 20 may be provided in one or more bundles. The bundles may be spaced along the length of the auxiliary equipment trailer 40 and may extend generally perpendicular to the longitudinal directions of the trailers 20, 30, 40.

Also, at the assembly location, the electrical equipment trailer 50 may be positioned as shown in FIGS. 1 and 2, disconnected from the respective towing vehicle, and then leveled, e.g., using a hydraulic leveling system or other leveling system. Components of the generator trailer 20, the turbine trailer 30, and/or the auxiliary equipment trailer 40 may be connected to components of the electrical equipment trailer 50 mechanically and/or electrically using cables, hoses, pipes, or other types of connecting lines, as described above. The connecting lines may be bundled together to allow the user to connect the components of the trailers 20, 30, 40, 50 together relatively quickly and easily. For example, connecting lines connecting the auxiliary equipment trailer 40 and the electrical equipment trailer 50 may be provided in one or more bundles. The bundles may be spaced along the lengths of the auxiliary equipment trailer 40 and the electrical equipment trailer 50, and may extend generally perpendicular to the longitudinal direction of the trailers 40, 50.

The walkways 70 may be moved from their stowed states to their deployed states on the auxiliary equipment trailer 40. For example, the walkways 70 may be rotated about their respective hinges 72, supported by respective brackets, and secured in place so that one walkway 70 extends between the auxiliary equipment trailer 40 and the connected generator and turbine trailers 20, 30, and another walkway 70 extends between the auxiliary equipment trailer 40 and the electrical equipment trailer 50.

After assembling the mobile power system 10 at the assembly location, the mobile power system 10 may be operated to generate power using the generator assembly of the generator trailer 20, the turbine assembly of the turbine trailer 30, the auxiliary equipment of the auxiliary equipment trailer 40, and the electrical equipment of the electrical equipment trailer 50. In an alternative embodiment, the trailers 20, 30, 40, 50 may be positioned and/or connected together in different orders.

After assembly, the auxiliary equipment trailer 40 may be positioned between and parallelly spaced from the electrical equipment trailer 50 and the connected turbine and generator trailers 20, 30. In the embodiment shown in FIGS. 1 and 2, the ends of the auxiliary equipment trailer 40 and the electrical equipment trailer 50 along the respective longitudinal directions do not extend past the ends of the connected turbine and generator trailers 20, 30. As a result, the footprint of the mobile power system 10 may be smaller since the configuration of the trailers 20, 30, 40, 50 may provide a more compact layout for the components of the mobile power system 10. For example, in an exemplary embodiment, the footprint may be less than approximately 88 feet by 40 feet, where the connected turbine and generator trailers 20, 30 may be less than approximately 88 feet long, the auxiliary equipment and electrical equipment trailers 40, 50 may each be less than approximately 53 feet long, and the maximum width between an outer side surface of the connected turbine and generator trailers 20, 30 and an outer side surface of the electrical equipment trailer 50 may be approximately 40 feet (e.g., the combined widths of the connected turbine and generator trailers 20, 30, the auxiliary equipment trailer 40, the electrical equipment trailer 50, and the two walkways 70).

Certain components of the trailers 20, 30, 40, 50 may be aligned with each other (generally perpendicular to the longitudinal directions of the trailers 20, 30, 40, 50) in order to provide relatively shorter connecting lines that provide mechanical and/or electrical connections between the components. For example, the air compressor system 42 may be generally aligned with the electrical equipment on the electrical equipment trailer 50 for connecting at least electrically to the air compressor system 42. The air compressor system 42 may also be generally aligned with the fuel system components on the turbine trailer 30 for connecting at least mechanically to the air compressor system 42. FIG. 2 shows the air compressor 42 aligned with the turbine trailer 30. Accordingly, the positioning of the fuel system components on the turbine trailer 30, the air compressor system 42 on the auxiliary equipment trailer 40, and the electrical equipment on the electrical equipment trailer 50 for connecting to the air compressor system 42 allows the connecting lines between these components to be relatively shorter. The connecting lines connecting these components may be generally perpendicular to the longitudinal directions of the trailers 20, 30, 40, 50.

Also, the fuel system components 44 generally near the middle of the auxiliary equipment trailer 40 may be generally aligned with the electrical equipment on the electrical equipment trailer 50 for connecting at least electrically to the fuel system components 44. The fuel system components 44 may also be generally aligned with a combustion section of the turbine trailer 30, and may be at least mechanically connected to the combustion section of the turbine trailer 30 to supply fuel to the combustion section. Accordingly, the positioning of the fuel system components 44 on the auxiliary equipment trailer 40, the combustion section of the turbine trailer 30, and the electrical equipment on the electrical equipment trailer 50 for connecting to the fuel system components 44 allows the connecting lines between these components to be relatively shorter. The connecting lines connecting these components may be generally perpendicular to the longitudinal directions of the trailers 20, 30, 40, 50.

Further, the oil cooler system 48 on the auxiliary trailer 40 may be filled with oil and may be generally aligned with the turbine trailer 30 to supply oil via at least mechanical connections (e.g., hoses). The oil cooler system 48 may also be generally aligned with electrical equipment on the electrical equipment trailer 50 for connecting at least electrically to the oil cooler system 48. Accordingly, the positioning of the components in the turbine trailer 30 for receiving oil from the oil cooler system 48, the oil cooler system 48 on the auxiliary equipment trailer 40, and the electrical equipment on the electrical equipment trailer 50 for connecting to the oil cooler system 48 allows the connecting lines between these components to be relatively shorter. The connecting lines connecting these components may be generally perpendicular to the longitudinal directions of the trailers 20, 30, 40, 50.

Also, the walkways 70 may be easily deployable and stowable, and serve as cat walks between the trailers 20, 30, 40, 50 to allow users to more easily access the various components of the trailers 20, 30, 40, 50. When the mobile power system 10 is positioned at the assembly location, the walkways 70 may be folded down via the hinges 72, and may provide a relatively safe and stable platform, e.g., for users to conduct maintenance work. The mechanical and electrical connecting lines described above may be placed at ground level below the walkways 70 or otherwise underneath the walkways 70. Thus, the walkways 70 may allow the connecting lines to be placed out of the way of the users.

In an exemplary embodiment, the mobile power system 10 may be a 15 megawatt power unit. Accordingly, the complete set of cabling, piping, and miscellaneous hardware necessary for interconnecting and operating the 15-megawatt mobile power system 10 may be provided. The mobile power system 10 also makes better use of plug-in electrical systems and flexible piping connections. The mobile power system 10 may be considered complete to the point that only fuel is needed in order to provide usable power with the mobile power system 10.

It will be apparent to those skilled in the art that various modifications and variations can be made to the mobile power system 10. Other embodiments will be apparent to those skilled in the art from consideration of the specification and practice of the disclosed mobile power system 10. It is intended that the specification and examples be considered as exemplary only, with a true scope being indicated by the following claims and their equivalents.

What is claimed is:

1. A mobile power system comprising:

a first transportable body including a generator assembly;

a second transportable body including a turbine assembly, one of the ends of the second transportable body being attached to and facing one of the ends of the first transportable body such that the first transportable body and the second transportable body are generally collinear;

a third transportable body including auxiliary equipment, and including a portion that is generally aligned with at least a portion of the first and second transportable bodies along a direction that is generally perpendicular to a longitudinal direction of the third transportable body;

a fourth transportable body including electrical equipment, the third transportable body being located between the fourth transportable body and the first and second transportable bodies;

wherein the first transportable body, the second transportable body, the third transportable body, and the fourth transportable body are separately transportable, and the first transportable body, the third transportable body, and the fourth transportable body are substantially parallel;

wherein the auxiliary equipment includes at least one of an air compressor system configured to supply air to the generator assembly and the turbine assembly; and wherein the air compressor system is generally aligned with the electrical equipment for connecting to the air compressor system in the fourth transportable body and with the turbine assembly along the direction that is generally perpendicular to the longitudinal direction of the third transportable body.

2. The mobile power system of claim 1, wherein:

the ends of the first transportable body include a first end and a second end positioned at opposite ends along a longitudinal direction of the first transportable body; and the ends of the second transportable body include a first end and a second end positioned at opposite ends along a longitudinal direction of the second transportable body.

3. The mobile power system of claim 1, wherein the turbine assembly and the auxiliary equipment both include fuel system components for liquid and gaseous fuels.

4. The mobile power system of claim 3, wherein the fuel system components of the auxiliary equipment are generally aligned with the fuel system components of the turbine assembly along the direction that is generally perpendicular to the longitudinal direction of the third transportable body.

5. The mobile power system of claim 3, wherein the fuel system components of the auxiliary equipment are generally aligned with the electrical equipment for connecting to the fuel system components, along the direction that is generally perpendicular to the longitudinal direction of the third transportable body.

6. The mobile power system of claim 1, wherein the auxiliary equipment includes an oil cooler system generally aligned with the turbine assembly and the electrical equipment for connecting to the oil cooler system, along the direction that is generally perpendicular to the longitudinal direction of the third transportable body.

7. The mobile power system of claim 1, further comprising at least one walkway attached to an outer surface of the third transportable body, the at least one walkway being configured to change between a deployed state and a stowed state.

8. The mobile power system of claim 7, wherein the at least one walkway is substantially vertical in the stowed state and substantially horizontal in the deployed state.

9. The mobile power system of claim 7, wherein:

the at least one walkway includes a first walkway and a second walkway;

the first walkway in the deployed state extends between the third transportable body and the first and second transportable bodies such that the first walkway allows a user to access the first, second, and third transportable bodies; and the second walkway in the deployed state extends between the third transportable body and the fourth transportable body such that the second walkway allows the user to access both the third and fourth transportable bodies.

10. The mobile power system of claim 1, wherein the electrical equipment includes at least one of a battery system, equipment for power conditioning, a connector for connecting to a local power grid, a power system protection device, a fire extinguisher system, or a remote control console.

11. The mobile power system of claim 1, wherein the first, second, third, and fourth transportable bodies are trailers.

12. The mobile power system of claim 1, wherein the mobile power system includes a gas turbine power generator.

13. The mobile power system of claim 1, wherein a component of the generator assembly is attached to a component of the turbine assembly so that the facing ends of the first and second transportable bodies are attached.

14. A method of assembling a mobile power system at an assembly location, the method comprising:

separately transporting to the assembly location a first transportable body, a second transportable body, a third transportable body, and a fourth transportable body of the mobile power system, the first transportable body including a generator assembly, the second transportable body including a turbine assembly, the third transportable body including auxiliary equipment, the fourth transportable body including electrical equipment;

attaching, at the assembly location, the first transportable body to the second transportable body such that the first transportable body and the second transportable body are generally collinear;

positioning, at the assembly location, the third transportable body generally parallel to the fourth transportable body and the attached first and second transportable bodies, and between the attached first and second transportable bodies and the fourth transportable body; and deploying at least one walkway when the third transportable body is positioned at the assembly location, the at least one walkway being attached to an outer surface of the third transportable body and configured to change between a deployed state and a stowed state.

15. The method of claim 14, wherein the at least one walkway is substantially vertical in the stowed state and substantially horizontal in the deployed state.

16. The method of claim 14, wherein the at least one walkway includes a first walkway and a second walkway, and deploying the at least one walkway includes:

deploying the first walkway such that the first walkway extends between the third transportable body and the first and second transportable bodies, and allows a user to access the first, second, and third transportable bodies; and deploying the second walkway such that the second walkway extends between the third transportable body and the fourth transportable body, and allows the user to access both the third and fourth transportable bodies.

17. The method of claim 14, wherein the first, second, third, and fourth transportable bodies are trailers.

18. The method of claim 14, wherein:

the ends of the first transportable body include a first end and a second end positioned at opposite ends along a longitudinal direction of the first transportable body; and the ends of the second transportable body include a first end and a second end positioned at opposite ends along a longitudinal direction of the second transportable body.

19. The method of claim 14, wherein attaching the first transportable body to the second transportable body includes attaching a component of the generator assembly to a component of the turbine assembly.

20. A method of assembling a mobile power system at an assembly location, the method comprising:

separately transporting to the assembly location a first trailer, a second trailer, a third trailer, and a fourth trailer of the mobile power system, the first trailer including a generator assembly, the second trailer including a turbine assembly, the third trailer including auxiliary equipment, the fourth trailer including electrical equipment;

attaching, at the assembly location, the first trailer to the second trailer such that the first trailer and the second trailer are generally collinear;

positioning, at the assembly location, the third trailer adjacent to the attached first and second trailers such that the third trailer is generally parallelly spaced from the attached first and second trailers;

positioning, at the assembly location, the fourth trailer adjacent to the third trailer such that the fourth trailer is generally parallelly spaced from the third trailer; and deploying at least one walkway when the third trailer is positioned at the assembly location, the at least one walkway being attached to an outer surface of the third trailer and configured to change between a deployed state and a stowed state.

21. The method of claim 20, wherein attaching the first trailer to the second trailer includes attaching a component of the generator assembly to a component of the turbine assembly.

22. A mobile power system comprising:

a first transportable body including a generator assembly;

a second transportable body including a turbine assembly, one of the ends of the second transportable body being attached to and facing one of the ends of the first transportable body such that the first transportable body and the second transportable body are generally collinear;

a third transportable body including auxiliary equipment, and including a portion that is generally aligned with at least a portion of the first and second transportable bodies along a direction that is generally perpendicular to a longitudinal direction of the third transportable body;

a fourth transportable body including electrical equipment, the third transportable body being located between the fourth transportable body and the first and second transportable bodies;

at least one walkway attached to an outer surface of the third transportable body, the at least one walkway being configured to change between a deployed state and a stowed state; and wherein the first transportable body, the second transportable body, the third transportable body, and the fourth transportable body are separately transportable, and the first transportable body, the third transportable body, and the fourth transportable body are substantially parallel.

23. The mobile power system of claim 22, wherein:

the ends of the first transportable body include a first end and a second end positioned at opposite ends along a longitudinal direction of the first transportable body; and the ends of the second transportable body include a first end and a second end positioned at opposite ends along a longitudinal direction of the second transportable body.

24. The mobile power system of claim 22, wherein the turbine assembly and the auxiliary equipment both include fuel system components for liquid and gaseous fuels.

25. The mobile power system of claim 24, wherein the fuel system components of the auxiliary equipment are generally aligned with the fuel system components of the turbine assembly along the direction that is generally perpendicular to the longitudinal direction of the third transportable body.

26. The mobile power system of claim 24, wherein the fuel system components of the auxiliary equipment are generally aligned with the electrical equipment for connecting to the fuel system components, along the direction that is generally perpendicular to the longitudinal direction of the third transportable body.

27. The mobile power system of claim 22, wherein the auxiliary equipment includes an oil cooler system generally aligned with the turbine assembly and the electrical equipment for connecting to the oil cooler system, along the direction that is generally perpendicular to the longitudinal direction of the third transportable body.

28. The mobile power system of claim 22, wherein the at least one walkway is substantially vertical in the stowed state and substantially horizontal in the deployed state.

29. The mobile power system of claim 22, wherein:

the at least one walkway includes a first walkway and a second walkway;

the first walkway in the deployed state extends between the third transportable body and the first and second transportable bodies such that the first walkway allows a user to access the first, second, and third transportable bodies; and the second walkway in the deployed state extends between the third transportable body and the fourth transportable body such that the second walkway allows the user to access both the third and fourth transportable bodies.

30. The mobile power system of claim 22, wherein the electrical equipment includes at least one of a battery system, equipment for power conditioning, a connector for connecting to a local power grid, a power system protection device, a fire extinguisher system, or a remote control console.

31. The mobile power system of claim 22, wherein the first, second, third, and fourth transportable bodies are trailers.

32. The mobile power system of claim 22, wherein the mobile power system includes a gas turbine power generator.

33. The mobile power system of claim 22, wherein a component of the generator assembly is attached to a component of the turbine assembly so that the facing ends of the first and second transportable bodies are attached.

* * * * *